US005726952A

United States Patent [19]

Eckert et al.

[11] Patent Number: 5,726,952

[45] Date of Patent: Mar. 10, 1998

[54] SOUND OR ULTRASOUND SENSOR

[75] Inventors: Manfred Eckert, Todtnau; Karl Flögel, Schopfheim, both of Germany

[73] Assignee: Endress + Hauser GmbH + Co., Maulburg, Germany

[21] Appl. No.: 847,714

[22] Filed: Apr. 28, 1997

[30] Foreign Application Priority Data

May 18, 1996 [DE] Germany ..... 196 20 133.0

[51] Int. Cl.[6] ..... H04R 17/00

[52] U.S. Cl. ..... 367/140; 367/158; 367/159; 367/162; 367/163; 367/174; 310/322

[58] Field of Search ..... 367/158, 159, 367/162, 163, 174, 140, 152; 310/322, 323, 333, 336; 73/632, 644

[56] References Cited

U.S. PATENT DOCUMENTS

| | | | |
|---|---|---|---|
| 2,943,297 | 6/1960 | Steinberger et al. | 367/155 |
| 3,370,186 | 2/1968 | Antonevich | 367/140 |
| 3,457,543 | 7/1969 | Akervold et al. | 367/140 |
| 3,739,327 | 6/1973 | Massa | 367/158 |
| 4,183,007 | 1/1980 | Baird | 367/119 |
| 4,633,119 | 12/1986 | Thompson | 310/325 |
| 5,218,575 | 6/1993 | Cherek | 367/140 |
| 5,452,267 | 9/1995 | Spevak | 367/163 |
| 5,515,342 | 5/1996 | Stearns et al. | 367/155 |

FOREIGN PATENT DOCUMENTS

| | | |
|---|---|---|
| 0 039 986 | 11/1981 | European Pat. Off. . |
| 29 06 704 | 8/1979 | Germany . |
| 1 553 933 | 10/1979 | United Kingdom . |

OTHER PUBLICATIONS

Noell, H., "Data processing in ultrasound-based liquid level-measuring instruments", Technisches Messen, 51. Jahrgang, 1984.

*Primary Examiner*—J. Woodrow Eldred

*Attorney, Agent, or Firm*—Bose McKinney & Evans

[57] ABSTRACT

A sound or ultrasound sensor is provided for transmitting and/or receiving sound or ultrasound, which is mechanically robust and chemically resistant and which has an adjustable emission characteristic, for example having a preferably small beam angle, having an emitting element (3) which has a flat front surface (34), and having a transducer element (1), the transducer element (1) causing the front surface (34) to oscillate on the basis of an excitation frequency, such that the entire front surface (34) carries out virtually in-phase deflections with virtually equal amplitude parallel to the normal to the front surface (34), and in which sensor concentric webs (32) are arranged on the front surface, there being a concentric gap (33) in each case between two adjacent webs (32), and a disk (5) sealing the sound or ultrasound sensor flush at the front, which disk is firmly connected to the webs (32) and has segments which are not connected to the webs (32) and are used as membranes (51).

6 Claims, 1 Drawing Sheet

SOUND OR ULTRASOUND SENSOR

Figure 1:
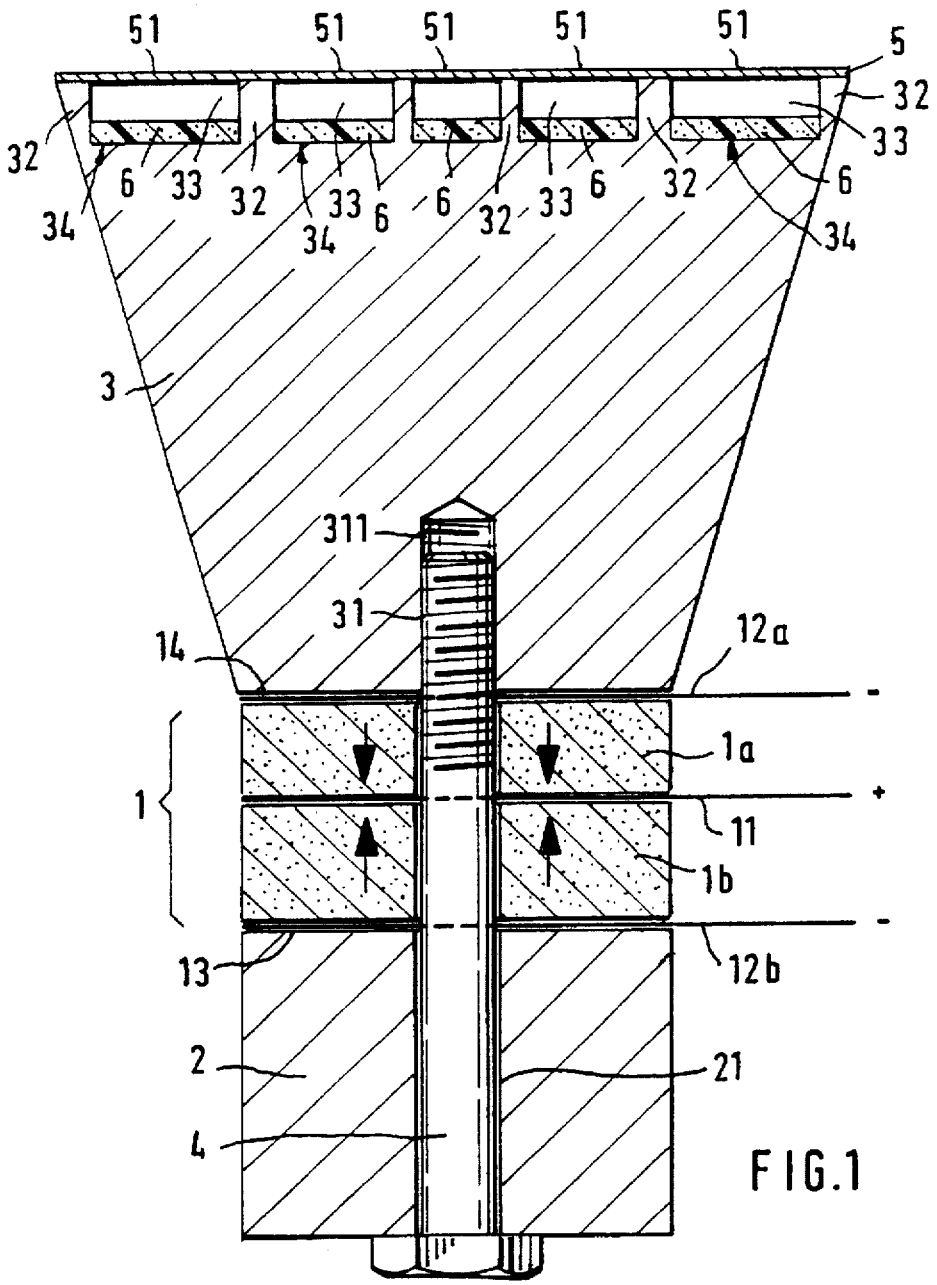

The invention relates to a sound or ultrasound sensor for transmitting and/or receiving sound or ultrasound. Ultrasound sensors are used, for example, as transmitters and/or receivers for distance measurement using the echo sounding principle, in particular for measuring a filling level, for example in a container, or for measuring a filling height, for example in a channel or on a conveyor belt.

A pulse which is transmitted by the sound or ultrasound sensor is reflected on the surface of the filling material. The pulse delay time from the sensor to the surface and back is determined, and the filling level or the filling height is obtained from this.

Such sound or ultrasound sensors are used in many branches of industry, for example in the food industry, the water and sewage areas and in the chemical industry. Sound or ultrasound sensors which have high chemical resistance and can be used over a wide temperature range are required particularly in the chemical industry. An additional requirement in the food industry is for such sensors preferably to be flush at the front and thus to be easy to clean.

It is necessary in all the cited fields of application for the sensors to have an emission characteristic with a small beam angle and a large main sound lobe, as well as small sidelobes.

DE-OS 29 06 704 discloses a sound or ultrasound sensor for transmitting and/or receiving sound or ultrasound, having an emitting element having a flat front surface and a sensor element, in which sensor the sensor element causes the front surface to oscillate, such that the entire front surface carries out virtually in-phase deflections with virtually equal amplitude parallel to the normal to the front surface.

The sensor in this case comprises a conical, metallic emitting element and a base body. A piezo-electric element which is clamped in between the emitting element and the base body and is excited into thickness oscillations is used as the transducer element.

The emission characteristic of the sensor is essentially governed by the diameter of the front surface and the frequency. In this case, the sine of the beam angle of the emitted sound lobe behaves like the quotient of the wavelength of the emitted sound or ultrasound wave and the diameter of the front surface of the emitting element. A large diameter must therefore be used to obtain a sound lobe having a small beam angle. However, the possible size of the diameter is limited by the fact that the front surface additionally carries out bending oscillations above a certain diameter. In consequence, the beam angle of the sound lobe always has a minimum size.

Since the acoustic impedance of the medium into which the sound or ultrasound is to be transmitted, for example air, and that of the emitting element differ to a very great extent, a matching layer made of an elastomer is arranged in front of the emitting element.

A disadvantage of such a sound or ultrasound sensor is that the temperature range in which the sensor can be used is limited by the use of the elastomer matching layer. On the one hand, elastomers can be used only over a narrower temperature range than metals, and on the other hand the speed of sound in elastomers is highly temperature-dependent. The matching layer is thus ineffective outside a temperature range predetermined by the elastomer.

Furthermore, a high-power sound sensor is described in the specialist article entitled: Meβwertverarbeitung in Ultraschall-Füllstandsmeβgeräten [Measurement processing in ultrasound filling level measurement equipment] on pages 313 to 317, in particular page 314, of the journal Technisches Messen [Metrology], 51st year, 1984, Issue 9, and this sensor comprises:

two metal cylinders, a transducer element which is clamped in between the metal cylinders, and a titanium cover which is screwed onto one of the metal cylinders and is designed as a membrane.

A metallic emitting element has a mechanical resistance which is greater than that of the matching layer and can be used over a wider temperature range.

The transducer element comprises two piezo-electric elements by means of which the sensor is excited to oscillate axially. If the excitation frequency is selected suitably, the membrane is thus caused to resonate.

The amplitude of the oscillation of the membrane is a maximum at the center of the membrane and decreases toward its edge.

However, the diameter of the membrane cannot be increased indefinitely since, above a certain diameter, and for a given thickness and a given excitation frequency, the membrane carries out higher-order bending oscillations. This can be avoided, for example, by using a stiffer membrane. However, the reception sensitivity of the sound or ultrasound sensor is severely reduced by a stiffer membrane. Since the membrane is subject to very high long-term alternating stresses, it is necessary to use a mechanically very high quality material, for example titanium. However, such materials are expensive.

The object of the invention is to specify a sound or ultrasound sensor which is mechanically robust and chemically resistant and which has an adjustable emission characteristic, for example with a preferably small beam angle.

To this end, the invention comprises a sound or ultrasound sensor for transmitting and/or receiving sound or ultrasound having an emitting element which has a flat front surface, and having a transducer element, the transducer element causing the front surface to oscillate on the basis of an excitation frequency, such that the entire front surface carries out virtually in-phase deflections with virtually equal amplitude parallel to the normal to the front surface, wherein concentric webs are arranged on the front surface,there is a concentric gap in each case between two adjacent webs, and a disk, composed in particular of metal, seals the sound or ultrasound sensor flush at the front, which disk is firmly connected to the webs and has segments which are not connected to the webs and are used as membranes.

According to a refinement of the invention, the membranes carry out bending oscillations whose resonant frequencies are greater than or equal to the excitation frequency.

According to a further advantageous refinement of the invention, the resonant frequency of the bending oscillation of the middle circular membrane is greater than or equal to the excitation frequency, and the resonant frequencies of the other membranes 51 rise from the inside to the outside.

According to another advantageous refinement of the invention, the resonant frequencies of the bending oscillations of the membranes are equal to one another and are considerably greater than the excitation frequency, and each membrane and those regions of the disk which adjoin the latter in each case and are connected to the webs oscillate in phase.

According to a further advantageous refinement of the invention, a damping material, in particular a foam, is introduced into the gaps.

According to a further advantageous refinement of the invention, the gaps have a depth which is slightly greater than a maximum deflection of the membranes which seal the gaps.

The advantages of the invention are that such a sound or ultrasound sensor has a smooth surface and can thus be cleaned particularly easily, that it has a metallic emitting surface, that is to say a surface which is chemically highly resistant and mechanically robust, that it can be used at temperatures of up to 150° C., and that its directional characteristic can be adjusted.

The invention and further advantages will now be explained in more detail with reference to the figures in the drawing, which illustrate two exemplary embodiments; identical elements are provided with the same reference symbols in the figures.

Figure 2:
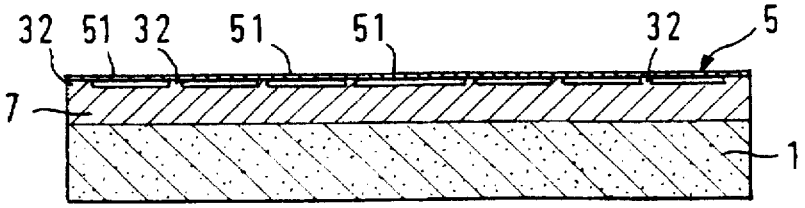

FIG. 1 shows a longitudinal section through a first sound or ultrasound sensor, and FIG. 2 shows a longitudinal section through a second sound or ultrasound sensor.

FIG. 1 illustrates an exemplary embodiment of a sound or ultrasound sensor according to the invention for transmitting and/or receiving sound or ultrasound. This sensor comprises a base body 2, an emitting element 3 and a cylindrical transducer element 1 which is clamped in between the base body 2 and the emitting element 3. The transducer element 1 carries out thickness oscillations in the axial direction and thus excites axial oscillations in the sound or ultrasound sensor.

In the exemplary embodiment illustrated in FIG. 1, the transducer element 1 comprises two piezo-electric elements 1*a*, 1*b* which are arranged one on top of the other, are in the form of annular disks and have mutually opposite polarization, which is illustrated symbolically by arrows, in the axial direction. An electrode 11 which is common to both piezo-electric elements 1*a*, 1*b* and is in the form of an annular disk is arranged between the two elements 1*a*, 1*b*. On the side facing away from the common electrode 11, each element 1*a*, 1*b* has a further, opposite electrode 12*a*, 12*b*, which is likewise in the form of an annular disk. The electrode 11 and the two opposite electrodes 12*a*, 12*b* are connected via connecting leads, which are not illustrated, to an AC source which is likewise not illustrated. In this case, the opposite electrodes 12*a*, 12*b* are at the same potential $U_1$, and the electrode 11 is at a potential $U_2$ which is phase-shifted through 180° with respect to the potential $U_1$.

The transducer element 1 constructed in this way has two circular end surfaces 13 and 14. The base body 2 is adjacent to the end surface 13. This base body 2 is a cylinder having a central, axial, inner through-hole 21. The base body 2 is composed of a material of high density, for example of steel, and produces a reduction in the sound energy which is emitted in the direction facing away from the emitting element.

The emitting element 3 is adjacent to the end surface 14. This emitting element 3 is a truncated conical component composed, for example, of aluminum. That circular surface of the truncated cone which has the greater diameter faces away from the transducer element 1 and forms a flat front surface 34. On the side facing the transducer element, the emitting element 3 has a central axial hole 31 which has an internal thread 311 and extends some distance into the truncated cone in the axial direction.

A clamping apparatus 4 is provided by means of which the transducer element 1 is clamped in between the base body 2 and the emitting element 3 in the axial direction, that is to say at right angles to its end surfaces 13, 14. In this exemplary embodiment, the clamping apparatus 4 is a clamping bolt which is inserted into the central inner hole 4 in the base body 2 from the side facing away from the transducer, passes through the transducer element 1 completely, and is screwed into the internal thread 311 in the hole 31 in the emitting element 3, so that the transducer element 1 is prestressed.

Concentric annular webs 32 are arranged on a front surface of the emitting element 3 facing away from the transducer element. There is a gap 33, in the form of an annular disk, in each case between two adjacent webs 32. This special geometry is produced, for example, by the gaps 32, which are in the form of annular disks, being turned out of an emitting element 3 which is initially in the form of a truncated cone. Since the emitting element 3 is preferably composed of a metal, in particular aluminum, this is a highly cost-effective and simple production method.

The sound or ultrasound sensor is sealed flush at the front by a preferably metallic disk 5, composed, for example, of aluminum or stainless steel, which is firmly connected, in particular welded, to the webs 32. The exposed segments of the disk 5 thus form membranes 51 which are in the form of circles or annular disks and are firmly clamped at their edge by the force-fitting connection to the webs 32.

The sound or ultrasound sensor is arranged, for example, in a cylindrical housing which is open at one end but is not illustrated in FIG. 1, the cavities which exist between the housing and the sound or ultrasound sensor being filled with an electrically non-conductive elastomer.

In the transmitting mode, the piezo-electric elements 1*a*, 1*b* are caused to oscillate in thickness by the AC voltage which can be applied to the electrode 11 and the opposite electrodes 12*a*, 12*b*. Since the transducer element 1 is firmly connected to the base body 2 and the emitting element 3 via the clamping apparatus 4, the composite oscillator formed from the transducer element 1, base body 2 and emitting element 3 carries out axial oscillations.

The flat front surface 34 of the emitting element 3 is thus caused to oscillate by the excitation frequency of the AC voltage in such a manner that the entire front surface 34 carries out virtually in-phase deflections with virtually equal amplitude, parallel to the normal to the front surface 34.

In order to achieve a front surface 34 oscillation amplitude which is as large as possible, the transducer element 1 is preferably driven at an excitation frequency which corresponds to the resonant frequency of the composite oscillator. The length L of the composite oscillator in the axial direction in this case corresponds to an integer multiple of half the wavelength of that imaginary wavelength which can be determined by weighted averaging of sound or ultrasound at the excitation frequency in the composite oscillator. This oscillation is transmitted to the membranes 51 by means of the webs 32. The membranes 51 carry out bending oscillations, since they are firmly connected to the webs 32 at the edge. These bending oscillations result in the ultrasound sensor being well matched to air. An amplitude increase occurs,that is to say the oscillation amplitude of the membranes 51 is greater than that of the webs 32. The amplitude increase is a maximum when the excitation frequency corresponds to the resonant frequency of the respective membrane 51. The bending oscillation of the respective membrane 51 is then phase-shifted through 180° with respect to the excitation frequency. The deflection of the respective membrane 51 is opposite to that of the webs 32 adjacent to it.

In this case, the respective membrane 51 and the two surfaces of the disk 5 which are firmly connected to the webs 32 adjacent to it transmit antiphase sound waves.

Destructive interference occurs. In order to keep the losses caused by this small, it is necessary for the sum of the areas of the membranes 51 to be large in comparison with the sum of the areas of the disk 5, which are firmly connected to the webs 32.

The further the resonant frequency of the respective membrane 51 is above the excitation frequency, the smaller is the described phase shift. However, the amplitude increase is reduced at the same time and thus the sound power emitted by the respective membrane 51 as well.

The resonant frequency of the respective membrane 51 is essentially governed by the mean radius of the membrane and the membrane stiffness. If the webs 32 are of the same width are spaced at equal distances apart in the radial direction, the resonant frequency of the outer membranes 51 would in consequence be lower than that of the inner membranes 51. Reducing the distance between two adjacent webs 32 in the radial direction increases the resonant frequency of the membrane 51 arranged between the webs.

The resonant frequency of all the membranes 51 is preferably above the excitation frequency. This precludes the occurrence of higher-order bending waves.

The emission characteristic of the sound or ultrasound sensor can be adjusted by means of the distances between the webs 32 in the radial direction, that is to say by tuning the resonant frequencies of the bending oscillation of the individual membranes 51 to one another and to the drive frequency. Two examples of this are quoted in the following text.

On the one hand, a sound or ultrasound sensor is achieved having an emission characteristic which is suitable for distance measuring using the echo sounding principle, in that the dimensions are set such that the resonant frequency of the circular middle membrane 51 is equal to or greater than the drive frequency, and the resonant frequencies of the other membranes 51, which are in the form of annular disks, are tuned such that a membrane 51 having a relatively small external radius has a lower resonant frequency than a membrane 51 having a relatively large external radius. The circular middle membrane 51 has the lowest resonant frequency.

The amplitude increase and thus the emitted sound energy thus reduces along the disk 5 from the inside to the outside. The amplitude distribution along a diagonal of the disk 5 corresponds approximately to a Gaussian curve. The sound energy emitted by sidelobes is considerably smaller than in the case of a pure piston oscillator without webs 32 and without a disk 5. On the other hand, virtually in-phase emission is achieved from all areas of the disk 5, in that the resonant frequencies of the membranes 51 are all the same and are considerably, for example 10%, higher than the excitation frequency. There is then virtually no phase shift between the oscillation of the individual membranes 51 and those areas of the disk 5 which are adjacent to them and are connected to the respectively adjacent webs 32.

If the sound or ultrasound sensor is used to transmit sound or ultrasound pulses of a specific duration, then care must be taken to ensure that the sound or ultrasound sensor rings as little as possible after the end of the excitation by the transducer element 1.

To this end, the distance between the membranes 51 and the front surface 34 of the emitting element 3, that is to say the depth of the gaps 33, is preferably dimensioned such that it is slightly greater than the maximum deflection of the membranes 51 which seal the gaps 33. The compression of the air contained in the gaps 33 by the bending oscillations of the membranes 51 produces damping, which considerably reduces the ringing of the sensor.

The ringing is likewise reduced by a damping material 6, for example a foam, being introduced into the gaps 33. Such a foam may, for example, be bonded onto the emitting element 3. In particular, the damping material 6 precludes the formation of waves running in an annular shape in the gaps 33.

The front structure of the composite oscillator which is formed by the webs 32 and the disk 5 results, because of the bending oscillation, in the acoustic impedance of the sound or ultrasound sensor being matched to the acoustic impedance of the medium into which the sound energy is to be transmitted. In particular, it is unnecessary to provide an additional layer composed of a material, for example of an elastomer, whose acoustic impedance is between that of the material of the disk 5 and that of the material into which the sound energy is to be transmitted.

A sound or ultrasound wave which arrives at the disk 5 produces bending oscillations in the disk 5, in particular in the membranes 51, which are passed on through the emitting element to the transducer element 1. This causes the piezo-electric elements **1*a* and 1*b* to oscillate. A piezo-electric voltage is produced, which can be accessed via the electrodes 11, 12*a* and 12*b*** for further processing.

The sound or ultrasound sensor is sealed by the preferably metallic disk 5. It can therefore be used at high temperatures up to about 150° C. The temperature range is limited only by the temperature range within which the transducer element 1 can be operated. Even greater temperature ranges can be achieved by increasing the distance between the transducer element 1 and the disk 5. In this case, care must be taken to ensure that the length L of the composite oscillator in the axial direction corresponds to an integer multiple of half the wavelength of that imaginary wavelength which can be determined by weighted averaging sound or ultrasound at the excitation frequency in the composite oscillator.

Since the emitting element, the webs 32 and the disk 5 are preferably composed of metal, only minor, temperature-dependent frequency discrepancies occur.

The sound or ultrasound sensor is chemically highly resistant and mechanically very robust. It is particularly well suited for applications in the food industry, since the disk 5 which comes into contact with the medium is flat and can thus be cleaned well. The invention is not limited to use in the described sensor but can actually be used in all sound or ultrasound sensors which have an emitting element with a flat front surface which is caused to oscillate by the transducer element 1 on the basis of an excitation frequency, in such a manner that the entire front surface carries out virtually in-phase deflections with virtually equal amplitude parallel to the normal to the front surface.

FIG. 2 shows a further exemplary embodiment of such a sound or ultrasound sensor.

In the case of the sound or ultrasound sensor which is illustrated only schematically as a longitudinal section in FIG. 2, the transducer element 1 has only a single piezo-electric element in the form of a disk. A covering plate 7, which is likewise in the form of a disk, is firmly connected to this transducer element 1 and has the same diameter. The covering plate 7 is excited to oscillate in the same way as the emitting element 3 in the exemplary embodiment which is illustrated in FIG. 1, in such a manner that its entire circular front surface facing away from the transducer carries out virtually in-phase deflections with virtually equal amplitude parallel to the normal to the front surface.

Concentric webs 32, on which the disk 5 is once again mounted, are arranged on the covering plate 7 in an analogous manner to the exemplary embodiment in FIG. 1.

The sound or ultrasound sensor is, for example, arranged in a cylindrical housing which is open at one end but is not illustrated in FIG. 2, the cavities which exist between the housing and the sound or ultrasound sensor being filled with an electrically non-conductive elastomer. In comparison with the exemplary embodiment which is illustrated in FIG. 1, the exemplary embodiment in FIG. 2 offers the advantage that it has a very small physical height and that a single piezo-electric element is sufficient to excite the sound or ultrasound transducer.

We claim:

1. A sensor for transmitting and/or receiving sound or ultrasound having an emitting element (3) which has a flat front surface (34), and having a transducer element (1), the transducer element (1) causing the front surface (34) to oscillate on the basis of an excitation frequency, such that the entire front surface (34) carries out virtually in-phase deflections with virtually equal amplitude parallel to the normal to the front surface (34), wherein concentric webs (32) are arranged on the front surface (34), there is a concentric gap (33) in each case between two adjacent webs (32), and a disk (5), seals the sensor flush at the front, which disk is firmly connected to the webs (32) and has segments which are not connected to the webs (32) and are used as membranes (51).

2. The sensor as claimed in claim 1, wherein the membranes (51) carry out bending oscillations whose resonant frequencies are greater than or equal to the excitation frequency.

3. The sensor as claimed in claim 2, wherein the resonant frequency of the bending oscillation of the middle membrane (51) is greater than or equal to the excitation frequency, and wherein the resonant frequencies of the other membranes (51) rise from the inside to the outside.

4. The sensor as claimed in claim 1, wherein the resonant frequencies of the bending oscillations of the membranes (51) are equal to one another and are considerably greater than the excitation frequency, and wherein each membrane (51) and those regions of the disk (5) which adjoin the latter in each case and are connected to the webs (32) oscillate in phase.

5. The sensor as claimed in claim 1, wherein damping material (6), in particular a foam, is introduced into the gaps (33).

6. The sensor as claimed in claim 1, wherein the gaps (33) have a depth which is slightly greater than a maximum deflection of the membranes (51) which seal the gaps (33).

* * * * *